United States Patent [19]

Meadows

[11] 4,071,998

[45] Feb. 7, 1978

[54] APPARATUS FOR CONTROLLING DISPENSING OF ARTICLES

[76] Inventor: Floyd G. Meadows, Rte. 2, Box 199A, Mena, Ark. 71953

[21] Appl. No.: 745,771

[22] Filed: Nov. 29, 1976

[51] Int. Cl.[2] ..... B65B 57/20

[52] U.S. Cl. ..... 53/59 R; 53/78; 235/98 R

[58] Field of Search ..... 53/35, 59 R, 78; 235/98 R; 221/7

[56] References Cited

U.S. PATENT DOCUMENTS

| | | | |
|---|---|---|---|
| 3,018,595 | 1/1962 | Harris et al. | 53/59 R X |
| 3,650,085 | 3/1972 | Bay | 53/59 R |

*Primary Examiner*—Travis S. McGehee

*Attorney, Agent, or Firm*—Hubbard, Thurman, Turner, Tucker & Glaser

[57] ABSTRACT

Apparatus and a method are disclosed for dispensing a plurality of articles, one at a time, at a filling zone into a plurality of containers so that when one of a series of containers is filled, the filling operation is automatically interrupted, the filled container is automatically moved from the filling zone, and an empty container positioned in the filling zone to be filled. The present invention employs a controllable gate for interrupting the dispensing of articles from a dispensing machine, a counter mechanism for counting the articles dispensed, a rotary table for carrying a plurality of containers past a dispensing chute on the dispensing machine, an apparatus for indexing the rotary table in response to the counting mechanism, and a second counting mechanism for counting the number of containers filled.

13 Claims, 8 Drawing Figures

APPARATUS FOR CONTROLLING DISPENSING OF ARTICLES

This invention relates to methods and apparatus for dispensing articles under control from a dispensing machine to a plurality of containers which move past the dispensing machine. One of the aspects of the present invention relates to counting and indexing apparatus for automatically controlling the dispensing cycle so that as one container is filled, the dispensing operation is interrupted, and an adjacent container is positioned to be filled.

In filling containers with tablets and other articles, it is common practice to pass a plurality of containers past a chute in a dispensing machine (commonly referred to as a tablet press) and to attempt to time the operation so that, upon the filling of one container, the next adjacent container is moved in position to be filled. Also, it has been common to employ a number of operators who manually position the containers and take them away when filled. These procedures, however, have some drawbacks because some spillage and waste can occur in the time that it takes to move a full container away from the delivery chute and to place an empty container adjacent it. In addition, the prior procedures described have also been expensive because of the number of personnel required to operate them. Since the machines which dispense the articles or tablets generally are relatively large and include rotating members which permit the tablets to be dropped out the delivery chute as the members rotate, it is not practical to interrupt this rotation and the delivery operation by stopping and starting the machine because of the starting and stopping forces involved. Thus, the present invention is directed to apparatus which permits the dispensing machine to be continuously operated, but automatically interrupts the dispensing of articles from the machine during the period of time from when one container is full and an adjacent empty container is placed in position to receive the article. Further, the present invention provides a system for counting the number of articles dispensed into each container to control the operation of the movement of the container past the delivery chute so that the same amount of tablets can be dispensed in each of the series of containers and a uniform product is delivered to the customer.

An important feature of the present invention is that little modification is required of the dispensing apparatus or tablet press and the modification that is required is relatively simple and inexpensive to make. The present invention can be readily adapted to be used with dispensing apparatus of different sizes and different manufacturers and is relatively simple to adjust and set up for different filling operations.

The advantages and features of the present invention are provided by utilization of means positioned on the dispensing machine which is responsive to the rotation and dispensing operation of the machine to provide a count each time an article is dispensed. A movable gate is provided on the delivery chute of the dispensing apparatus and means is further provided which is responsive to a predetermined count of the articles dispensed to close the gate to permit a filled container to be moved from a filling zone adjacent the gate for receipt of dispensed articles, and to permit an empty container to be placed in such a position at which time the gate is automatically opened again and the delivery operation commenced. The containers for the dispensed articles can be mounted on a rotary table which is driven to permit adjacent containers to be positioned below the delivery chute. Means is also provided for causing the movement of the rotary table in response to a predetermined count of articles dispensed so that the desired sequence of operation of movement of the containers to and from the delivery position is affected. Also, it is preferred that a time delay means also be provided which is actuated at the time that the delivery gate is closed to keep it closed for a predetermined period of time sufficient to permit removal of a filled container and placement of an empty container in the filling zone. Further, a batch counter may be provided which gives a count of the number of containers filled to provide a desired batch.

In the drawings, wherein is disclosed a preferred embodiment of this invention, and wherein like reference numerals are used throughout to designate like parts;

Figure 1:
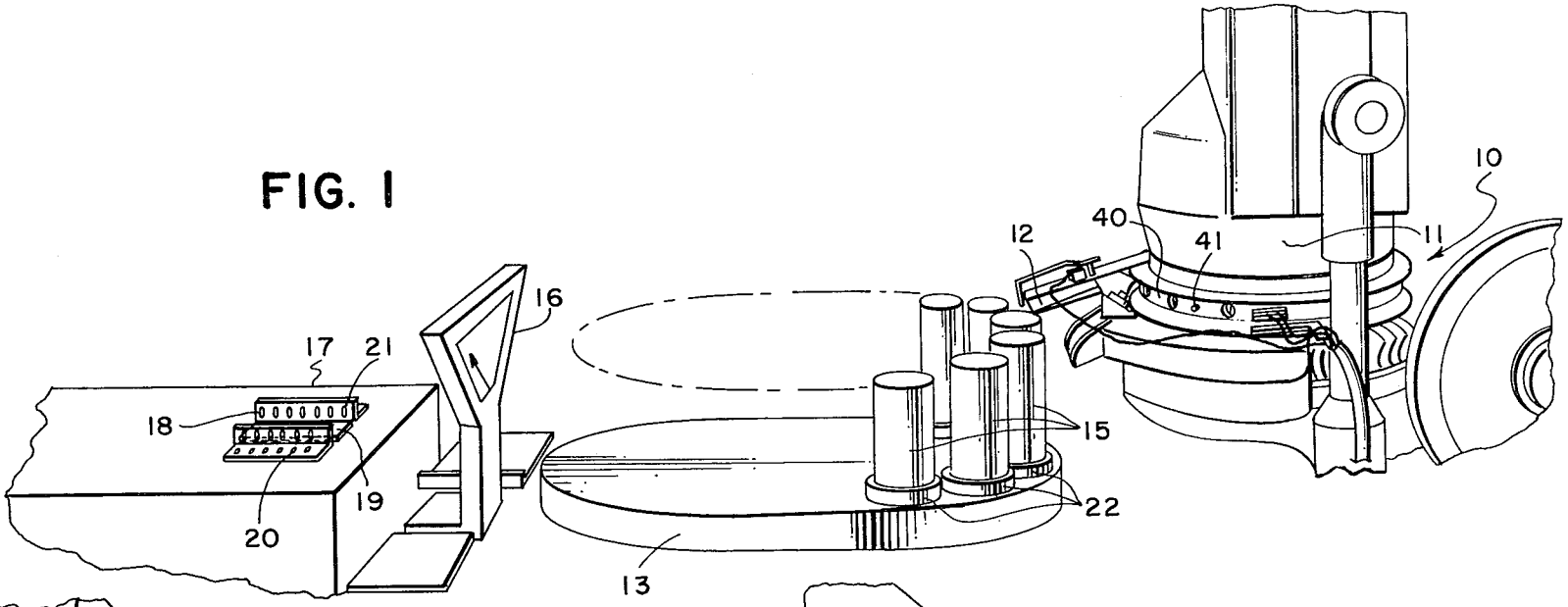
FIG. 1 is a view in elevation illustrating the total system employing the present invention for dispensing articles into a plurality of containers, including the dispensing machine, and the rotary table for supporting the container to the filled.
Figure 3:
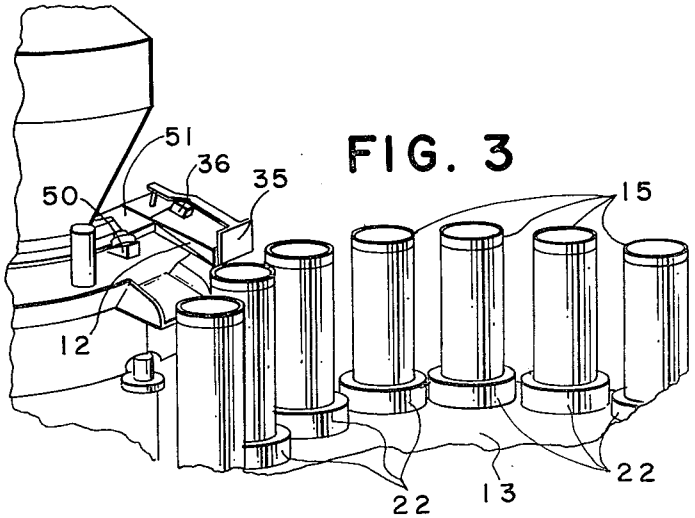
FIG. 3 is a view in elevation illustrating the relationship between the delivery chute and the container with the delivery gate illustrated as being closed.

Referring now to FIG. 1, the dispensing apparatus or tablet press 10 is illustrated as including a rotational member 11 and a delivery chute 12. Apparatus 10 is conventional and is well known in the art, and as rotating member 11 rotates a plurality of tablets, pills or other articles are caused to be slung out of the chute 12 as is well known in the art. Supported adjacent apparatus 10 is a circular rotary table 13 which is mounted, as hereinafter described, on a table 14 (shown in FIG. 2 but now shown in FIG. 1) to support a plurality of containers 15 as they are rotated past a filling zone adjacent delivery chute 12 as shown in FIGS. 1 and 3. For purposes of completing the system of FIG. 1, a scale 16 may be provided adjacent rotary table 13 and a table 17 may be provided adjacent to scale 16 and include an apparatus 18 for shaking and uniformally distributing tablets in each of the containers as they are taken from the table 13. Shaking mechanism 18 may include a vibrating belt 19 which is caused to vibrate back and forth under control of a vibrator motor (not shown), and parallel angle plates 20 and 21. Thus, a container 15 which is to be shaken on belt 19 is placed on the belt, on its long side, and between plate 20 and 21. The remaining space on the top of table 17 may be utilized to stack filled containers or as a work surface.

Thus, with the system described one person may move filled containers 15 from table 13, weigh them, and place them on the shaker, and place unfilled containers on table 13 as the dispensing operation is in progress. As fully described below, since the dispensing operation is automatically controlled by the present invention, the operator is free to perform the steps required without having to be concerned with removing containers at a critical time just as they are filled and quickly place an empty container below the chute.

As illustrated in FIG. 3 rotary table 13 includes a plurality of mounting cups 22 aligned in a circle completely about the table which is also circular. Thus, each of the plurality of containers 15 is driven past delivery chute 12 as table 13 is caused to rotate about its axis.

Figure 2:
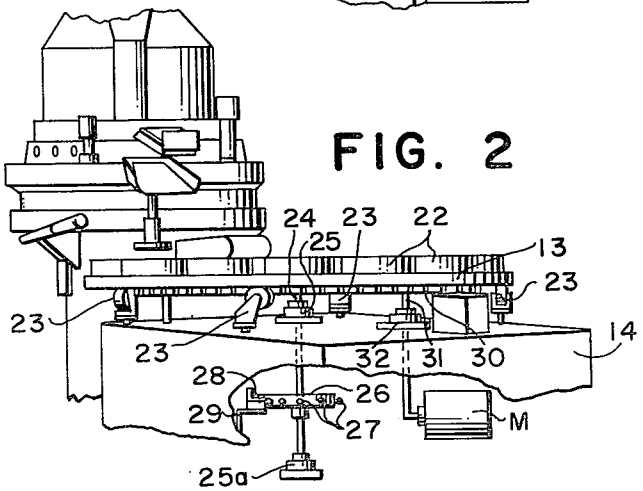
FIG. 2 is a view in elevation and partial cutaway showing the manner in which the rotary table is mounted and supported for rotation.

As illustrated in FIG. 2 rotary table 13 is mounted on top of table 14 by four spaced apart rollers or wheels 23 by a shaft 24 extending through a bearing 25 from the center of rotary table 13 through the top of table 14 and into its interior. Shaft 24 is mounted at its other end on a bearing 25*a* in the interior of a table 14 and follows the rotation of the table. A circular disc 26 is mounted on shaft 24 as illustrated in FIG. 2 to also rotate with the shaft, and includes a plurality of projections 27, which may be screw head positioned about the periphery of disc 26 to correspond to the angular position of each of cups 22 about rotating table 13. For example, if the center cups are located 12° apart (providing for 30 cups about the top of table 13) then 30 screw heads at 12° apart would be provided about the periphery of circular disc 26. Also, a micro-switch 28 is mounted on bracket 29 in the interior of table 14 so that it can be actuated in response to the movement of each of the screw heads 27 past the actuating member of the switch. It is preferred that the position of the micro-switch be adjustable so that when it is actuated by one of heads 27, one of the containers 15 is directly under chute 12. The operation of switch 28 will be described along with the description of the electrical schematic of FIG. 8.

As illustrated also in FIG. 2 a ring gear 30 is also provided about the periphery of rotating table 13, on the lower side thereof to be engaged by a smaller gear (now shown) connected to a shaft 31 extending through a bearing 32 into the interior of table 14 where it is connected to be operated by a motor M. Each time motor M is actuated it causes table 13 to rotate to move containers 15 past the filling zone located beneath the chute 12. The detailed operation of motor M will be described in the description of the schematic shown in FIG. 8.

Figure 4:
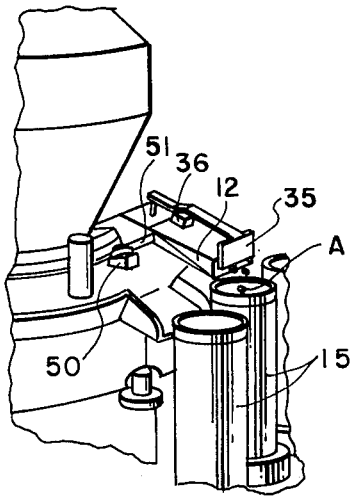
FIG. 4 is a view similar to FIG. 3, but with only a partial portion of the delivery apparatus being shown illustrating the delivery gate being opened.

As illustrated in FIGS. 3 and 4 chute or hopper 12 includes a hopper gate 35 movable by a solenoid 36 between a position in which gate 35, as shown in FIG. 3, blocks the opening chute 12 to prevent articles (designated by the reference A in FIG. 4) from passing from a chute, to a position as shown in FIG. 4 where gate 35 is open sufficiently to permit articles A to fall into container 15.

As illustrated in FIG. 1 dispensing apparatus 10 includes a rotating member on disc 11 from which an article A emerges into chute 12 at a predetermined angular position during the rotation of disc 11 during the dispensing operation. For example, a single complete rotation of mechanism 11 may cause five tablets to be dispensed from apparatus 10, one for each 72° of rotation of disc 11. Thus, if a protrusion or marker 41 is placed on rotating mechanism 11 each 72°, and these markers are counted during rotation of disc 11, an accurate count is provided of the number of articles dispensed during the operation of apparatus 10. In FIG. 1 only one such marker 41, which in this case may be the head of a bolt screwed into rotating mechanism 11 it is shown for purposes of illustration, it being understood that a number of such markers would be equally made about the periphery of rotating mechanism 11, equal to the number of articles dispensed during one rotation of disc 11.

Figure 5:
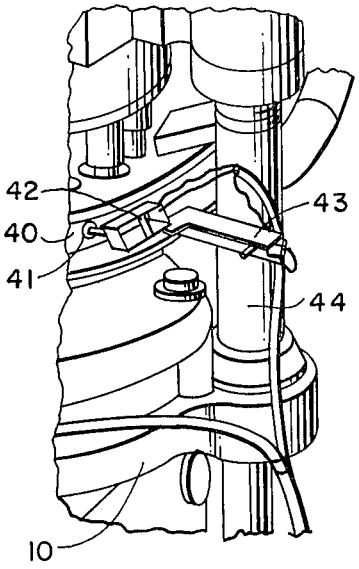
FIG. 5 is a view in elevation of the delivery apparatus of FIG. 1 illustrating the mounting of a microswitch adapted to count the number of articles dispensed from the dispensing apparatus.

In order to count each of the markers 41 a micro-switch 42 is mounted by a bracket 43 on a shaft 44 of dispensing apparatus 10. The actuating member of the micro-switch is aligned with respect to disc 11 so that as the marker or bolt head 41 passes by the switch, as shown in FIG. 5, the switch is actuated. Again, FIG. 8 illustrates the operation of switch 41 in the electrical system of this invention.

Figure 6:
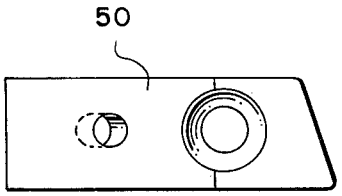
FIGS. 6 and 7 are top and side views respectfully of a support block designed to control the elevation and angular inclination of the delivery chute depending from the apparatus.
Figure 7:
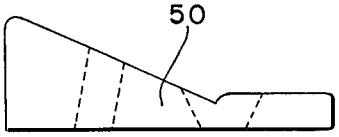

FIGS. 6 and 7 illustrate the manner in which the elevation and angular inclination of chute 12 may be set and adjusted to provide for the dispensing of tablets or other articles into different heights of containers. Chute 12 may be pivotally mounted on apparatus 10 and, as shown in FIG. 6 a wedge 50 is provided which is mounted under an arm 51 which extends laterally from chute 12 in order to raise the chute up to the desired height. The wedge can be made larger or smaller as required to change the height of the chute, or a screw adjustment may be provided between wedge 50 and arm 51 to change the angle of inclination of the chute.

Figure 8:
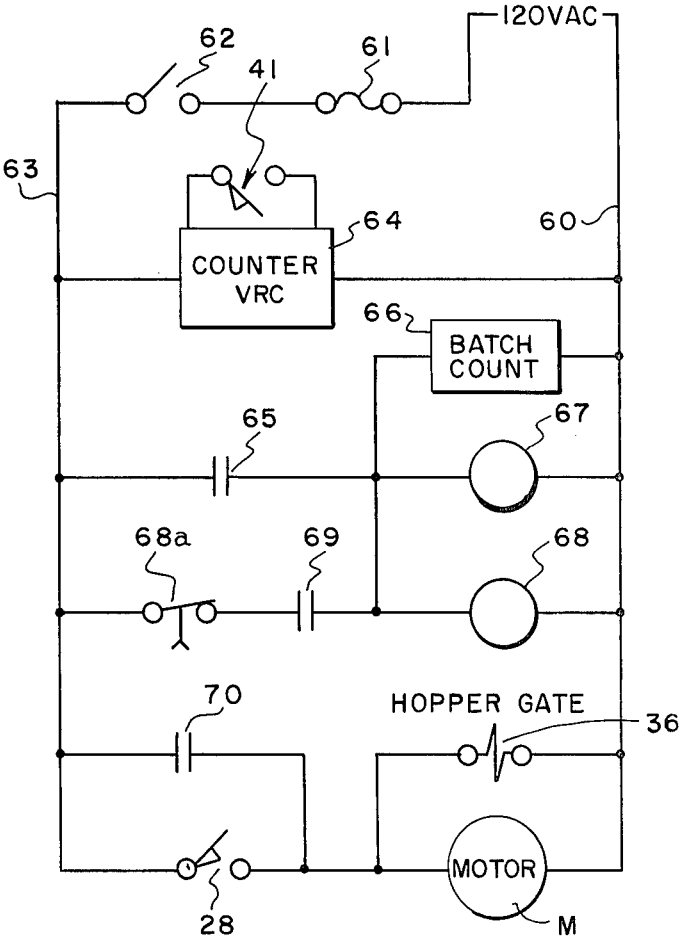
FIG. 8 is an electrical schematic of the control apparatus of the delivery system of FIG. 1.

Referring now to FIG. 8, the connection of the various components of the present apparatus and their operation is described. As illustrated in FIG. 8 one side of 120 volt AC line voltage is represented by reference numeral 60 and the other side, which passes through a fuse 61 and an on-off switch 62, is represented by a reference numeral 63. Connected across the line voltage 60–63 is a counter 64 which provides a count up to a previously set number in response to the closure of switch 41 which is connected across the input terminals of the counter. The counter can be manually set to a preselected number and includes a pair of switch contacts 65 which momentarily close when a preset number is reached. For example, if it is desired to dispense 50 tablets to each of the containers 15, when the counter reaches a count of 50, contacts 65 will close. Connected to be operated by contacts 65, and by the connection through these contacts to line 63, is a batch counter 66, dpdt relay 67, and a spst time delay relay 68. Thus, each time a container is filled and contacts 65 close, batch counter 66 will indicate a count so that the operator can determine how many containers have been filled. Counter 64 and batch counter 66 may be mounted on the top of table 14 so as to be visible to the operator, or they may be mounted flush with the table top, or even on the side of the table. Relay 67, which is also actuated in response to closing of terminal 65, is preferably a double pole, double throw relay and includes a first set of contacts 69 and a second set of contacts 70. The relay is self-latching so that when contacts 69 close in response to the closure of contacts 65, current is conducted through contacts 69 to the coil of the relay to keep it actuated. Also in series with the path of line 63 through contacts 69 are normally closed contacts 68*a* of time relay 68, so that when contacts 65 are initially closed, contacts 68*a* are also closed to permit the current to flow through contacts 69, but current is also conducted to the coil of relay 68 to start its time delay period.

Also, when relay 67 is actuated, its contacts 70 are also closed to conduct current to gate solenoid 36 and motor M to start the rotation of rotary table 13 and close gate 35. Contacts 70 are connected in parallel to limit switch 28 which, as was previously described, includes normally closed contacts, and is actuated by the rotation of disc 26. When one of containers 15 is at its correct position beneath chute 12, switch 28 is in contact with one of screw heads 27, and the switch is open as shown in FIG. 8. As also shown in FIG. 8, each of contacts 70 and switch 28 will conduct the current to solenoid 36 and motor M when in their conducting state. Thus, as contacts 70 are closed, motor M is caused to rotate to cause switch 28 to move its contacts off of one of screw heads 27. When this occurs the contacts of switch 28 are closed and continue to be so until the next adjacent screw head 27 is contacted. While motor M is moving rotary table 13 and disc 26 between adjacent positions, time delay relay 68, which has its contacts in series with contacts 69 of relay 67, is actuated to cause contacts 68*a* to open thus removing line voltage 63 from contacts 69 and causing relay 67 to open. However, even though this occurs while motor M is moving rotary table 13, since switch 28 has its contacts closed as long as it is not actuated by one of screw heads 27, the motor will continue to run until the contacts of switch 28 are actuated by the next adjacent screw head, stopping the motor with an empty container in position to be filled, and also causing hopper gate 50 to be opened again. When this occurs, counter 64 is ready to count the articles dispensed into a new empty container 15 (in fact while the gate is closed articles are still dispensed into the chute and counted and accumulated until the chute is opened). When the full count on the counter is reached again then the sequence of operation previously described is commenced to move the full container from the filling zone and to position the adjacent empty container in the filling zone.

Thus, with the apparatus described each of containers 15 is automatically filled with a predetermined number of articles, the filling operation is automatically interrupted by closure of gate 36, motor M is automatically actuated to move rotary table 13 until the next adjacent empty container 15 is positioned to be filled, and gate 35 is automatically opened and the empty container is positioned to continue the filling operation. As noted, batch counter 66 counts the number of containers filled so that the operator can determine when the desired number of containers have been filled. With the operation described only one operator need be involved in the operation of taking filled containers and weighing them on a scale 16 and shaking them in shaker 18. If desired, he can place a number of empty containers in the center of rotary table 13 so that these can be inserted into cups 22 as filled containers are removed. Since the operator is not involved in the timing of placement and removal of filled and empty containers from the filling zone, it is a relatively simple task for him to perform the other steps in the operation, as time allows.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is.

1. A system for dispensing a plurality of articles into a plurality of containers comprising, in combination:

a dispensing apparatus including a delivery chute and a rotating member from which a plurality of articles are dispensed in sequence into said delivery chute;

a rotary table adapted to support a plurality of article containers for selective movement pass said delivery chute so that dispensed articles may fall from said delivery chute into said containers;

a movable gate for selectively interrupting the flow of articles from said delivery chute;

means for rotating said rotary table;

count means for counting the number of articles dispensed by said dispensing apparatus in response to the rotational position of said rotating member to provide an electrical control signal when the count of articles dispensed reaches a predetermined number;

means responsive to said electrical control signal to cause said gate to close to interrupt the flow of articles from said delivery chute, and to cause said means for rotating said rotary table to be actuated, and means responsive to the rotational position of said rotary table to stop the rotation thereof when a container is in position to receive articles from said chute, and to cause said gate to open to permit dispensed articles to fall into said container.

2. The system of claim 1 further including a solenoid responsive to an electrical impulse and connected to operate said gate to and from its open and closed positions.

3. The system of claim 1 wherein said count means includes a plurality of marker means mounted about the periphery of said rotary member, a micro-switch mounted on said dispensing apparatus so that it may be contacted and actuated by each of said marker means as they pass by said micro-switch, and a counter responsive to actuation of said micro-switch to record a count, said counter including switch means responsive to a preselected count being reached to provide said electrical control signal.

4. The system of claim 1 wherein said means responsive to said electrical control signal is a control relay including contacts adapted to conduct current to said gate and said rotary means when closed.

5. The system of claim 1 wherein said means responsive to the rotational position of said rotary table includes a circular disc, a shaft connecting said disc to said rotary table so that the disc follows the rotation of said table, and a plurality of container marker means spaced about the periphery of said disc, each of said container marker means being disposed on said disc at an angular position corresponding to the angular position of one of said article containers on said rotary table, and switch means mounted to be actuated by each of said container marker means to cause said rotational means to stop and said gate to open.

6. The system of claim 4 further including time delay means responsive to said electrical control signal to interrupt the flow of current to said control relay a preselected time after actuation in response to said electrical control signal, but prior to the time that the container being moved into position is in such position.

7. The system of claim 1 further including means for changing the height and angular inclination of said delivery chute.

8. The system of claim 2 wherein said count means includes a plurality of marker means mounted about the periphery of said rotary member, a micro-switch mounted on said dispensing apparatus so that it may be contacted and actuated by each of said marker means as they pass by said micro-switch, and a counter responsive to actuation of said micro-switch to record a count, said counter including switch means responsive to a preselected count being reached to provide said electrical control signal.

9. The system of claim 8 wherein said means responsive to said electrical control signal is a control relay including contacts adapted to conduct current to said gate and said rotating means when closed.

10. The system of claim 9 wherein said means responsive to the rotational position of said rotary table includes a circular disc, a shaft connecting said disc to said rotary table so that the disc follows the rotation of said table, and a plurality of container marker means spaced about the periphery of said disc, each of said container marker means being disposed on said disc at an angular position corresponding to the angular position of one of said article containers on said rotary table, and switch means mounted to be actuated by each of said container marker means to cause said rotational means to stop and said gate to open.

11. The system of claim 10 further including time delay means responsive to said electrical control signal to interrupt the flow of current to said control relay a preselected time after actuation in response to said electrical control signal, but prior to the time that the container being moved into position is in such position.

12. The system of claim 11 further including means for changing the height and angular inclination of said delivery chute.

13. The system of claim 1 further including a batch counter responsive to said electrical control signal to count the number of containers filled during a desired operation.

* * * * *